US008917149B2

(12) United States Patent
Blech et al.

(10) Patent No.: US 8,917,149 B2
(45) Date of Patent: Dec. 23, 2014

(54) ROTARY JOINT FOR SWITCHABLY ROTATING BETWEEN A JOINTED AND NON-JOINTED STATE TO PROVIDE FOR POLARIZATION ROTATION

(75) Inventors: Marcel Daniel Blech, Herrenberg (DE); Stefan Koch, Oppenweiler (DE)

(73) Assignee: Sony Corporation, Tokyo (JP)

( * ) Notice: Subject to any disclaimer, the term of this patent is extended or adjusted under 35 U.S.C. 154(b) by 296 days.

(21) Appl. No.: 13/413,148

(22) Filed: Mar. 6, 2012

(65) Prior Publication Data

US 2012/0242428 A1 Sep. 27, 2012

(30) Foreign Application Priority Data

Mar. 22, 2011 (EP) ..... 11159229

(51) Int. Cl.
*H01P 1/165* (2006.01)
*H01P 1/06* (2006.01)

(52) U.S. Cl.
CPC ..... *H01P 1/065* (2013.01); *H01P 1/165* (2013.01)
USPC ..... 333/21 A; 333/257

(58) Field of Classification Search
CPC ..... H01P 1/06; H01P 1/062; H01P 1/065; H01P 1/165
USPC ..... 333/256, 257, 261, 21 A
See application file for complete search history.

(56) References Cited

U.S. PATENT DOCUMENTS 3,588,751 A * 6/1971 Paine ..... 333/137
3,906,407 A * 9/1975 Levaillant et al. ..... 333/21 A
4,233,576 A * 11/1980 Pelchat ..... 333/16
4,353,041 A * 10/1982 Bryans et al. ..... 333/21 A
4,843,357 A 6/1989 Stern et al.
5,781,087 A 7/1998 Milroy et al.
7,212,087 B2 5/2007 Nagai
2004/0027210 A1 2/2004 Chan et al.
2010/0134217 A1 6/2010 Rosenberg et al.

FOREIGN PATENT DOCUMENTS

WO WO 2010/106198 A1 9/2010

OTHER PUBLICATIONS

Jorge A. Ruiz-Cruz et al., "Multi-Section Bow-Tie Steps for Full-Band Waveguide Polarization Rotation", IEEE Microwave and Wireless Components letters, vol. 20, No. 7, Jul. 2010, pp. 375-377.

* cited by examiner

*Primary Examiner* — Benny Lee
(74) *Attorney, Agent, or Firm* — Oblon, Spivak, McClelland, Maier & Neustadt, L.L.P.

(57) ABSTRACT

The present invention relates to a rotary joint for joining two waveguides for guiding electromagnetic waves, comprising a first portion adapted to receive a first waveguide, a second portion adapted to receive a second waveguide, and a third portion adapted for polarization rotation and arranged between the first portion and the second portion. The rotary joint is configured such that two portions selected from the group comprising the first portion, the second portion and the third portion are rotatable between at least two different angular positions around a central axis. Further, the rotary joint being configured to switch between a jointed state, in which the portions contact each other for electrical connection, and a non-jointed state. The present invention also relates to a method of operating such a rotary joint and a computer program and a computer readable non-transitory medium for implementing such a method.

21 Claims, 7 Drawing Sheets

ROTARY JOINT FOR SWITCHABLY ROTATING BETWEEN A JOINTED AND NON-JOINTED STATE TO PROVIDE FOR POLARIZATION ROTATION

CROSS-REFERENCE TO RELATED APPLICATIONS

The present application claims priority of European patent application 11 159 229.1 filed on Mar. 22, 2011.

FIELD OF THE INVENTION

The present invention relates to a rotary joint for joining two waveguides for guiding electromagnetic waves, in particular two hollow rectangular waveguides. The present invention also relates to a method of operating such a rotary joint and a computer program and a computer readable non-transitory medium for implementing such a method.

BACKGROUND OF THE INVENTION

In antenna measurements, particularly in near-field measurements, the acquisition of two orthogonal field components is essential. Normally, this is done by rotating a field-probe by 90° around its central axis, typically an open ended waveguide or horn antenna. The first polarization of an antenna under test is measured by the probe in the first orientation of the antenna under test, and the orthogonal polarization can be acquired in the second orientation.

However, turning the probe requires the feed line to be moved also. This induces some undesired amplitude and/or phase errors. For higher frequencies the losses normally become undesirably high.

U.S. Pat. No. 5,781,087 discloses a rectangular waveguide rotary joint that allows limited mechanical rotation of two rectangular waveguides around a common longitudinal axis. The joint comprises a first rectangular waveguide having a first waveguide flange and a second rectangular waveguide having a second waveguide flange, wherein the second waveguide flange is disposed adjacent to the first waveguide flange with an air gap disposed there between. An RF choke is formed in the waveguide flanges for reducing RF leakage caused by the air gap, and a low friction spacer system for separating the first and second waveguides to maintain relative alignment of the waveguides during rotation and maintain a substantially constant separation between the waveguides.

For higher frequencies, especially frequencies above e.g. 50 GHz, there can be rotary joints in which the fundamental mode in a rectangular waveguide is transformed to a rotationally symmetric mode in a circular section. This transformation must be employed on both sides of a circular waveguide section. Thus, the losses are relatively high and the mechanical dimensions are very bulky.

SUMMARY OF THE INVENTION

It is an object of the present invention to provide a rotary joint, especially for higher frequencies, in which losses are reduced and which still has a relatively compact design. It is a further object of the present invention to provide a method of operating such a rotary joint as well as a corresponding computer program for implementing such a method.

According to an aspect of the present invention there is provided a rotary joint, for joining two waveguides for guiding electromagnetic waves, which comprises a first portion adapted to receive a first waveguide, a second portion adapted to receive a second waveguide, and a third portion adapted for polarization rotation and arranged between the first portion and the second portion. The rotary joint is configured such that two portions selected from the group comprising the first portion, the second portion and the third portion are (in particular each) rotatable between at least two different angular positions about a central axis. The rotary joint is configured to switch between a jointed state, in which the portions contact each other for electrical connection, and a non jointed state.

According to a further aspect of the present invention there is provided a method of operating a rotary joint, for joining two waveguides for guiding electromagnetic waves. The rotary joint comprises a first portion adapted to receive a first waveguide, a second portion adapted to receive a second waveguide, and a third portion adapted for polarization rotation and arranged between the first portion and the second portion. The rotary joint is configured such that two portions selected from the group comprising the first portion, the second portion and the third portion are (in particular each) rotatable between at least two different angular positions about a central axis. The method comprises switching between a jointed state, in which the portions contact each other for electrical connection, and a non jointed state, and rotating, each of the two rotatable portions between the at least two different angular positions.

According to still further aspects, a computer program comprising program means for causing a computer to carry out the steps of the method according to the present invention, when the computer program is carried out on a computer, as well as a computer readable non-transitory medium having instructions stored thereon which, when carried out on a computer, cause the computer to perform the steps of the method according to the present invention are provided.

It shall be understood that the claimed method, the claimed computer program and the claimed computer readable medium have similar and/or identical preferred embodiments as the claimed rotary joint and as defined in the dependent claims.

The present invention is based on the idea to provide a rotary joint in which the portions contact each other for electrical connection in a jointed state such that a good electrical connection is provided, especially for higher frequencies. Thus, losses and phase errors are reduced. Also, a good shielding from undesired electromagnetic waves in the environment of the rotary joint is provided. The rotary joint can switch to a non-jointed state, in particular in which there is less, preferably no, contact pressure and/or abrasion, compared to the jointed state, between the portions, in particular between the contact surfaces for electrical connection (electrical contact surfaces). All this reduces mechanical stress and abrasion and ensures proper operation over a long life time. Since there is less abrasion, the transmission of the electromagnetic waves is more predictable, as the unknown variable caused by abrasion over time is reduced or eliminated. For example an antenna measurement, especially the measurement of the co-polar component and cross-polar component, can thus be more predictable and/or precise. Further, a relatively compact design of the rotary joint can be provided. Also, no transition from rectangular waveguide to circular waveguide is necessary and no mode converters for circular waveguide modes or mode filters are necessary, which reduces the losses. The direction of the vector of the electric field of the electromagnetic wave (polarization) in the fundamental mode can be rotated in an easy manner. In particular, when the rotary joint is used as a polarizer, exactly the same amplitude and phase response can be expected for the two different angular positions or polarizations due to geometrical symmetry. Furthermore a high bandwidth over the entire waveguide band can be provided.

BRIEF DESCRIPTION OF THE DRAWINGS

These and other aspects of the present invention will be apparent from and explained in more detail below with reference to the embodiments described hereinafter. Like features in different drawings may be designated by the same reference labels and such reference labels may not be described with respect to all drawings. In the following drawings

DETAILED DESCRIPTION OF THE INVENTION

Figure 1A:
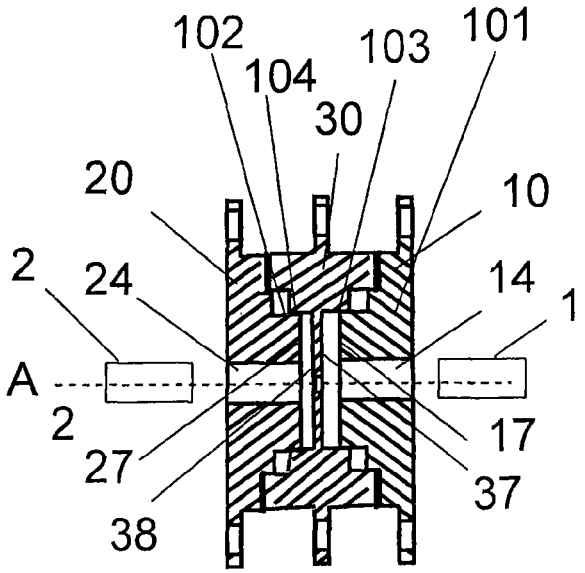
FIG. 1*a* shows a sectional side view a rotary joint according to a first embodiment in a non-jointed state.
Figure 1B:
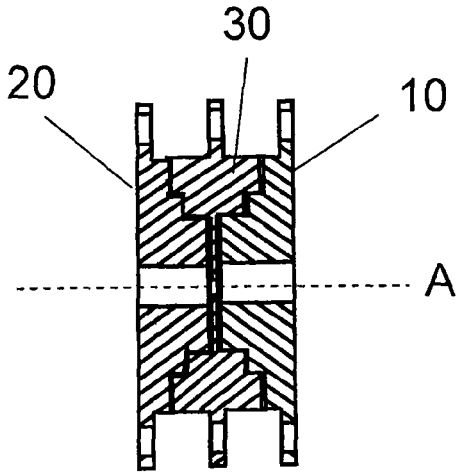
FIG. 1*b* shows a sectional side view of the rotary joint according to the first embodiment in a jointed state.

FIG. 1*a* shows a sectional side view of a rotary joint according to a first embodiment in a non-jointed state and FIG. 1*b* shows the same rotary joint in a jointed state. The rotary joint comprises a first portion 10 adapted to receive a first hollow rectangular waveguide 1 (e.g., FIG. 1*a*), a second portion 20 adapted to receive a second hollow rectangular waveguide 2 (e.g., FIG. 1*a*), and a third portion 30 adapted for polarization rotation and arranged between the first portion 10 and the second portion 20. The first portion 10, the second portion 20 and the third portion 30 are each a slab. This means that their radial dimensions are much larger than their width. In particular, the portions 10, 20, 30 are each a round slab. Each of the portions 10, 20, 30 can be made of a single part or of multiple parts.

In FIG. 1*a* and FIG. 1*b*, the first portion 10 comprises a first opening 14 adapted to receive the first rectangular waveguide 1, and the second portion 20 comprises a second opening 24 adapted to receive the second rectangular waveguide 2. The first opening 14 (e.g., FIG.1*a*) and the second opening 24 (e.g., FIG.1*a*) each have a shape for receiving the respective waveguide, which is a rectangular shape in the illustrated embodiments. Other suitable waveguide shapes and corresponding shapes of the openings can also be employed. The first waveguide 1 and the second waveguide 2 can be inserted, adhered, soldered, screwed, or in any other suitable way be attached to the first portion 10 and the second portion 20, respectively. The first portion 10 and the second portion 20 can alternatively be a standard waveguide interface themselves.

The rotary joint is in particular adapted for electromagnetic waves of a frequency of more than 50 GHz, and more particularly a frequency of more than 110 GHz. These frequencies correspond to a wavelength in the millimeter range or even smaller.

In the illustrated embodiments, the portions 10, 20, 30, thus the first portion 10, the second portion 20 and the third portion 30, are coaxially aligned along the central axis A. The rotary joint is configured such that two portions selected from the group comprising the first portion 10, the second portion 20 and the third portion 30 are (in particular each) rotatable between at least two different angular positions around the central axis A. This will be further explained with reference to FIGS. 4 to 9.

The rotary joint is configured to switch between a jointed state, in which the portions 10, 20, 30 contact each other for electrical connection, and a non-jointed state. In the non-jointed state, there is less, preferably no, contact pressure and/or abrasion, compared to the jointed state, between the portions 10, 20, 30, in particular between the contact surfaces for electrical connection (electrical contact surfaces). Thus, when rotating the rotatable portions 20, 30, there is less mechanical stress and abrasion between the portions 10, 20, 30, and therefore proper operation over a long lifetime can be ensured. In the illustrated embodiments there are gaps between the portions 10, 20, 30 in the non-jointed state. However, any other suitable means to provide less or to remove contact pressure and/or abrasion can be provided. For example, merely the amount of contact pressure can be reduced, in particular to a level which enables easy rotating of the rotatable portions.

Figure 2A:
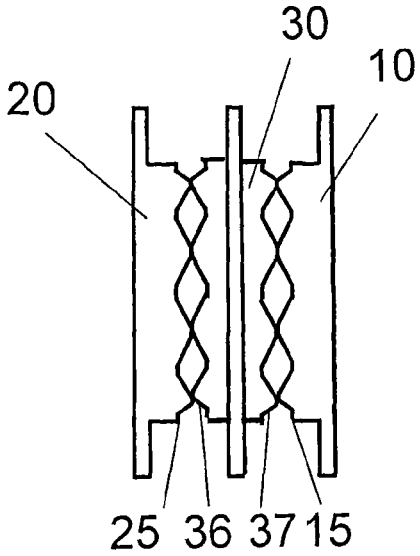
FIG. 2*a* shows a side view of the rotary joint of FIG. 1*a,*
Figure 2B:
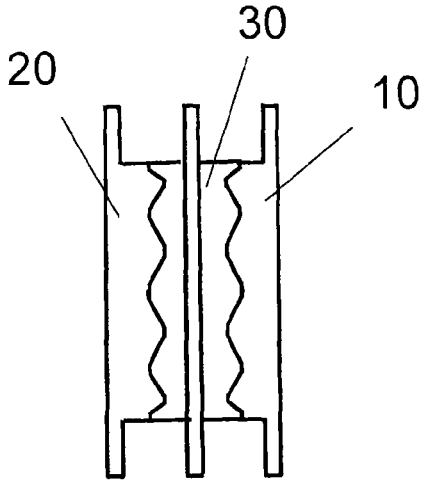
FIG. 2*b* shows a side view of the rotary joint of FIG. 1*b,*
Figure 3A:
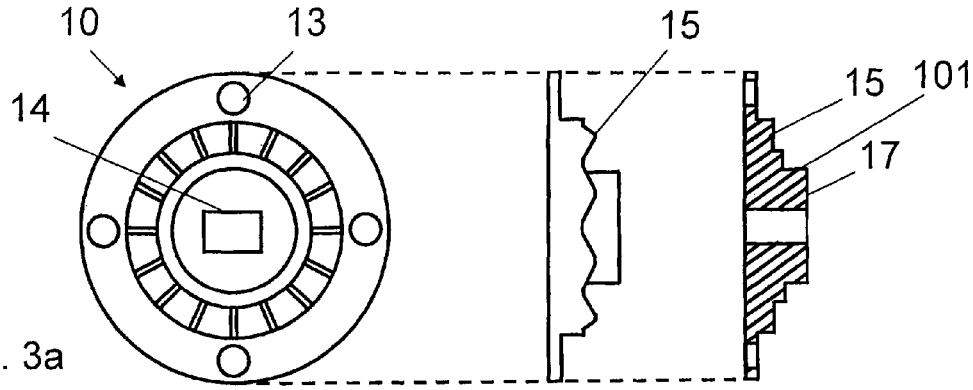
FIG. 3*a* shows a front view, a side view and a sectional side view of the first portion of the rotary joint according to the first embodiment.
Figure 3B:
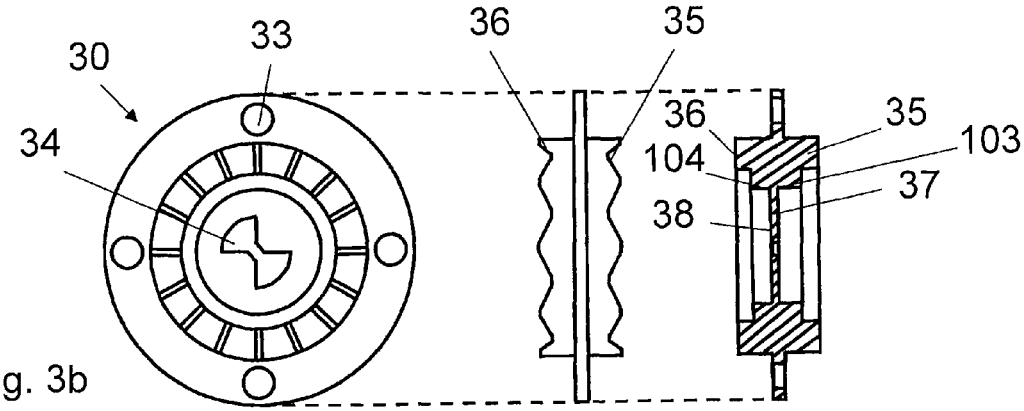
FIG. 3*b* shows a front view, a side view and a sectional side view of the third portion of the rotary joint according to the first embodiment.
Figure 3C:
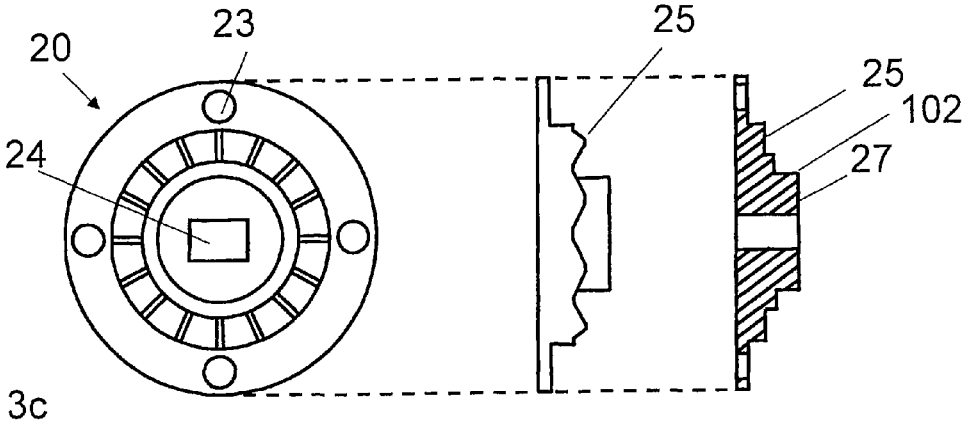
FIG. 3*c* shows a front view, a side view and a sectional side view of the second portion of the rotary joint according to the first embodiment.

FIG. 2*a* shows a side view of the rotary joint of FIG. 1, in the non-jointed state, and FIG. 2*b* shows a side view of the rotary joint of FIG. 1, in the jointed state. For each of the first portion 10, the second portion 20 and the third portion 30 a front view, a side view and a sectional side view are shown in FIG. 3*a*, FIG. 3*b* and FIG. 3*c*, respectively.

The third portion 30 comprises a third opening 34 for polarization rotation in the slab. The third opening 34 in FIG. 3*b* has a bow tie shape. Alternatively, the third opening can also have another suitable shape. For example, the third opening in FIG. 3*b* may be rectangular in shape with an adjustable length A and height B, and preferably with a fixed ratio B/A of 0.5. The bow tie shaped opening ensures a high bandwidth, low losses, and has very compact dimensions. The third portion 30 can be very thin in the area surrounding the third opening 34, compared to the remaining areas or parts of the third portion 30.

In the jointed state, as shown in FIG. 1*b* and FIG. 2*b*, the first portion 10, the third portion 30 and the second portion 20 contact each other for electrical connection. In particular, in the jointed state (e.g., FIG. 1*a*), a first electrical contact surface 17 of the first portion 10 and a third electrical contact surface 37 of the third portion 30 contact each other for electrical connection, and a second electrical contact surface 27 of the second portion 20 and a fourth electrical contact surface 38 of the third portion 30 contact each other for electrical connection. This provides for a good electrical connection in the jointed state, especially for higher frequencies.

In the non-jointed state, there is less (or no) contact pressure and/or abrasion, compared to the jointed state, between the electrical contact surfaces 17, 27, 37, 38. Thus, when rotating the rotatable portions 20, 30, there is less mechanical stress and abrasion between the electrical contact surfaces 17, 27, 37, 38, and therefore proper operation over a long lifetime can be ensured. The electrical contact surfaces 17, 27, 37, 38 are arranged in a plane perpendicular to the central axis A. The electrical contact surfaces 17, 27, 37, 38 are adapted to guide the electromagnetic waves when in contact with each other. Each electrical contact surface 17, 27, 37, 38 surrounds the respective opening 14, 24, 34 of its portion 10, 20, 30. The first electrical contact surface 17 surrounds the first opening 14. The second electrical contact surface 24 surrounds the second opening 27. The third electrical contact surface 37 and the fourth electrical contact surface 38 each surround the third opening 34 and are arranged on opposite sides of the slab. The electrical contact surfaces 17, 27, 37, 38 are made of an electrically conducting material, for example, comprising a conducting metal. Optionally, the electrical contact surfaces 17, 27, 37, 38 can be gold plated, e.g. a few microns of gold, for even better conductance and durability.

In the non-jointed state, there is less (or no) contact pressure and/or abrasion, compared to the jointed state, between the first electrical contact surface 17 and the third electrical contact surface 37 and between the second electrical contact surface 27 and the fourth electrical contact surface 38. In the embodiments shown in FIG. 1*a* and FIG. 2*a*, this is achieved by having gaps between the first portion 10, the third portion 30, and the second portion 20, such that the electrical contact surfaces 17, 27, 37, 38 do not contact each other. Thus, there is no contact pressure between the electrical contact surfaces 17, 27, 37, 38 in the non-jointed state, and consequently there is also no abrasion. In particular, a first gap is formed between the first electrical surface 17 of the first portion 10 and the third electrical contact surface 37 of the third portion 30, and a second gap is formed between the second electrical contact surface 27 of the second portion 20 and the fourth electrical contact surface 38 of the third portion 30, in the non-jointed state.

The rotary joint is adapted to switch between the jointed state and the non-jointed state by rotating the two rotatable portions 20, 30 such that the portions 10, 20, 30 are lifted away from each other in the direction of the central axis A. In particular, as can be seen in FIG. 1*a*, the electrical contact surfaces 17, 27, 37, 38 are lifted away from each other in the direction of the central axis A.

The rotary joint further comprises mechanical contact surfaces 15 (e.g., FIG. 3*a*), 25 (e.g., FIG. 3*c*), 35, 36 (e.g., FIG. 3*b*). Each of these mechanical contact surfaces 15, 25, 35, 36 contacts its adjacent or opposing mechanical contact surface at at least some point in both the jointed and the non-jointed state. In the jointed state and the non-jointed state, as can be seen in FIG. 2*b* and FIG. 2*a*, a first mechanical contact surface 15 of the first portion 10 and a third mechanical contact surface 35 of the third portion 30 contact each other, and a second mechanical contact surface 25 of the second portion 20 and the fourth mechanical contact surface 36 of the third portion 30 contact each other. The mechanical contact surfaces 15, 25, 35, 36 are arranged in a plane perpendicular to the central axis A. The mechanical contact surfaces 15, 25, 35, 36 are in form of a ring around the central axis A. The mechanical contact surfaces 15, 25, 35, 36 can be made of the same material as the electrical contact surfaces 17, 27, 37, 38. Alternatively, they can be made of a different material. In particular, they can be made of a material with a high abrasion resistance.

As can be seen in FIG. 2*a*, FIG. 2*b*, FIG. 3*a*, FIG. 3*b* and FIG. 3*c*, the mechanical contact surfaces 15, 25, 35, 36 are in the form of a cam or wave having multiple alternating convex and concave partitions. In the jointed state, as can be seen in FIG. 2*b*, the convex partitions of each of the mechanical contact surfaces engage with the concave partitions of its adjacent or opposing mechanical contact surface, and vice versa. In particular, in the jointed state the convex partitions of the first mechanical contact surface 15 engage with the concave partitions of the third mechanical contact surface 35 and the convex partitions of the second mechanical contact surface 25 engage with the concave partitions of the fourth mechanical contact surface 36. In the non-jointed state, as can be seen in FIG. 2*a*, the convex partitions of each of the mechanical surfaces (15, 25, 35, 36) contact the convex partitions of its adjacent or opposing mechanical contact surface. Thus, there are gaps between the concave partitions of each of the mechanical contact surfaces (15, 25, 35, and 36) and the concave partitions of its adjacent or opposing mechanical contact surface. In particular, in the non-jointed state the convex partitions of the first mechanical contact surface 15 contact the convex partitions of the third mechanical contact surface 35 and the convex partitions of the second mechanical contact surface 25 contact the convex partitions of the fourth mechanical contact surface 36. The amplitude of the concave and convex partitions, or the cam or wave, is sufficient to lift the electrical contact surfaces 17, 27, 37, 38 away from each other. The convex and concave partitions are arranged such that an angular spacing between two of the concave partitions or between two of the convex partitions depends on the at least two angular positions mentioned above. This means that the concave partitions and the convex partitions are arranged or spaced depending on the desired angular positions of the two rotatable portions 20, 30. In particular, the angular spacing between two consecutive concave partitions or convex partitions can correspond to the angle between the at least two angular positions. Thus, the two rotatable portions 20, 30 can easily be rotated between the two angular positions by simply rotating the mechanical contact surfaces 15, 25, 35, 36 between two of the convex or concave partitions.

The portions 10, 20, 30 further each comprise a guiding surface for aligning the portions 10, 20, 30 along the central axis A and such that they are coaxially aligned along the central axis A. In FIG. 1*a*, the first portion 10 comprises a first guiding surface 101, the second portion 20 comprises a second guiding surface 102 and the third portion comprises a third guiding surface 103 and a fourth guiding surface 104. In the jointed or non-jointed state the first guiding surface 101 and the third guiding surface 103 contact each other and the second guiding surface 102 and the fourth guiding surface 104 contact each other. Each guiding surface 101, 102, 103, and 104 is a ring surrounding the central axis A.

Figure 4:
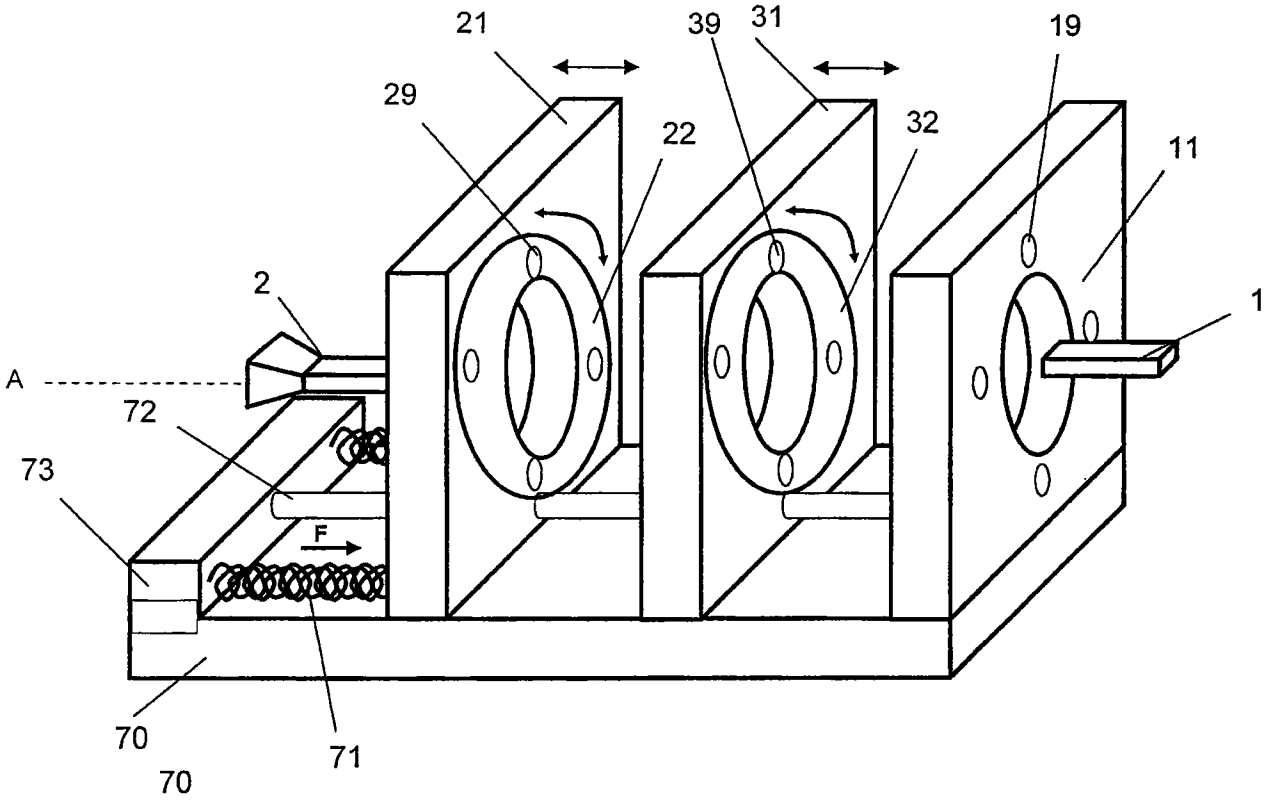
FIG. 4 shows a perspective view of a mounting part of the rotary joint according to the first embodiment.

FIG. 4 shows a perspective view of a mounting part of a rotary joint according to an embodiment. As can be seen in FIG. 4, the first waveguide 1 is a hollow rectangular waveguide and the second waveguide 2 is a hollow rectangular waveguide feeding a horn antenna. For simplification purposes, the portions 10, 20, 30 of F*igs*. 1*a*, 1*b*, 2*a*, 2*b*, and 3*a*-3*c* are not shown in FIG. 4. The rotary joint of the embodiment of FIG. 4 is configured such that the first portion 10 is fixed and such that the second portion 20 and the third portion 30 are each rotatable between the at least two different angular positions around the central axis A.

The rotary joint comprises a first adapter 11 which is stationary and to which the first portion 10 is attachable. The first stationary adapter 11 is attached to a base plate 70. The first portion 10 shown in FIG. 3*a* is attachable to the first stationary adapter 11 in FIG. 4 by means of fasteners through holes 13 (e.g., FIG. 3*a*) provided in the first portion 10 and corresponding holes 19 provided in the first stationary adapter 11. Also, the first waveguide 1 is attachable to the first opening 14 (e.g., FIG. 3*a*) of the first portion 10 as explained above.

The rotary joint further comprises a second adapter 21 and a second rotatable adapter part 22. The second rotatable adapter part 22 is rotatable attached to the second adapter 21. The second portion 20 is attachable to the second rotatable adapter part 22. The second portion 20 shown in FIG. 3*c* is attachable to the second rotatable adapter part 22 in FIG. 4 by means of fasteners through holes 23 (e.g., FIG. 3*c*) provided in the second portion 20 and corresponding holes 29 provided in the second rotatable adapter part 22. The second adapter 21 is movable in the direction of the central axis A, as indicated in FIG. 4.

The rotary joint further comprises a third adapter 31 and a third rotatable adapter part 32. The third rotatable adapter part 32 is rotatable attached to the third adapter 31. The third portion 30 is attachable to the third rotatable adapter part 32. The third portion 30 shown in FIG. 3*b* is attachable to the third rotatable adapter part 32 in FIG. 4 by means of fasteners through holes 33 (e.g., FIG. 3*b*) provided in the third portion 30 and corresponding holes 39 provided in the third rotatable adapter part 32. The third adapter 31 is movable in the direction of the central axis A, as indicated in FIG. 4. In general, there can be more than two movable adapters and rotatable adapter parts, as pointed out in the second embodiment with reference to FIG. 7*a* and FIG. 7*b*.

The rotary joint further comprises an actuator adapted to rotate the second portion 20 and the third portion 30. In the embodiment of FIG. 4 an actuator in form of a motor can be provided in or near each of the second adapter 21 and the third adapter 31. A first actuator or motor can rotate the second rotatable adapter part 22 to which the second portion 20 is attached, and a second actuator or motor can rotate the third rotatable adapter part 32 to which the third portion 30 is attached. Thus, the second portion 20 and the third portion 30 are independently from each other rotatable. Alternatively, a single actuator or motor, in particular in conjunction with a gearbox, can be used to rotate both the second portion 20 and the third portion 30.

As already explained, the rotary joint is not only adapted to rotate the second portion 20 and the third portion 30 around the central axis A, but also to switch between the jointed state and the non-jointed state by rotating the second portion 20 and the third portion 30 such that the portions 10, 20, 30 are lifted away from each other in the direction of the central axis A. However, in the jointed state, the portions 10, 20, 30 should not move in the direction of the central axis A. As can be seen in FIG. 4, the rotary joint therefore further comprises a tension device 71 adapted to press the portions 10, 20, 30, in particular their electrical contact surfaces 17, 27, 37, 38, against each other. The tension device 71 is adapted for applying a force F in the direction of the central axis A. The tension device 71 is in form of a spring in FIG. 4. Alternatively, the tension device can be any other suitable tension device. The tension device 71 is attached to the base plate 70 in a stationary manner. Thus, the force F applied by the tension device 71 always presses the mechanical contact surfaces 15, 25, 35, 36 of the portions 10, 20, and 30 together, in both the jointed state and the non-jointed state. The force F applied by the tension device 71 also presses the electrical contact surfaces 17, 27, 37, 38 against each other for contact in the jointed state, thus applying contact pressure. In the non jointed state, the force F applied by the tension device 71 can be reduced or eliminated. Thus, in the non-jointed state, there is less or no contact pressure between the electrical contact surfaces 17, 27, 37, 38, compared to the jointed state.

The rotary joint further comprises one or more connecting rods 72 mounted between the stationary part 11 and a part 73 of the base plate 70. This rod is used for connecting and accurately guiding the movement of the first adapter 21 and the second adapter 31 in direction of the central axis A. FIG. 4 shows an exploded view, in which the stationary part 11 and the first and second adapters 21 and 31, and therefore also the portions 10, 20, 30, are equidistantly spaced. However, the distances in between are only for illustration purposes.

Figure 5A:
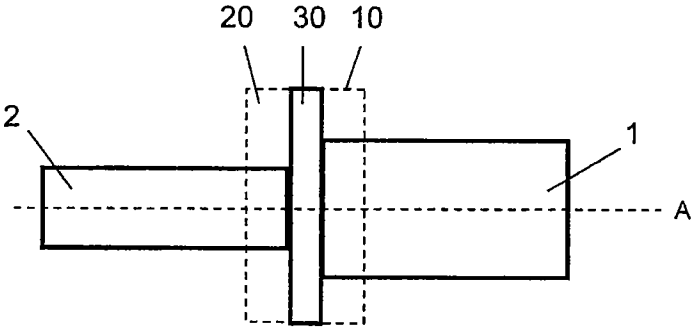
FIG. 5*a* shows a simplified side view of the rotary joint according to the first embodiment.
Figure 5B:
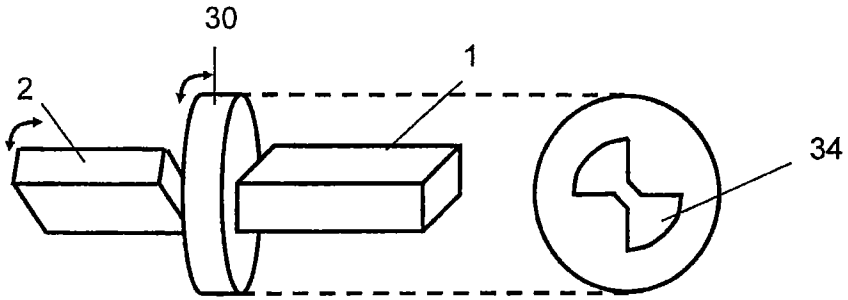
FIG. 5*b* shows a simplified perspective view of the rotary joint according to the first embodiment.

Now, the rotation about the central axis A will be explained in more detail. FIG. 5*a* shows a simplified side view of a rotary joint according to the first embodiment and FIG. 5*b* shows a respective simplified perspective view. For simplification purposes, the first portion 10 and the second portion 20 are only shown by dotted lines in FIG. 5*a* and are not shown in FIG. 5*b*. As previously explained, the rotary joint is configured such that the first portion 10, to which the first waveguide 1 is attached, is fixed and such that the second portion 20, to which the second waveguide 2 is attached, as well as the third portion 30 adapted for polarization rotation are each rotatable between at least two different angular positions around the central axis A. In general, when the rotary joint is used as a polarizer, exactly the same amplitude and phase response can be expected for the two different angular positions or polarizations due to geometrical symmetry, which will be explained in more detail below.

One application of the rotary joint is for antenna measurement. In this case, the first waveguide 1 is connected to a signal generator, and the second waveguide 2 is a probe, employed to measure the horizontally and vertically polarized components of the pattern of an antenna under test. For an antenna measurement, particularly in a near field measurement, the acquisition of two orthogonal field components is essential. The direction of the vector of the electric field of the electromagnetic wave (or polarization) in the fundamental mode is rotated.

Figure 6A:
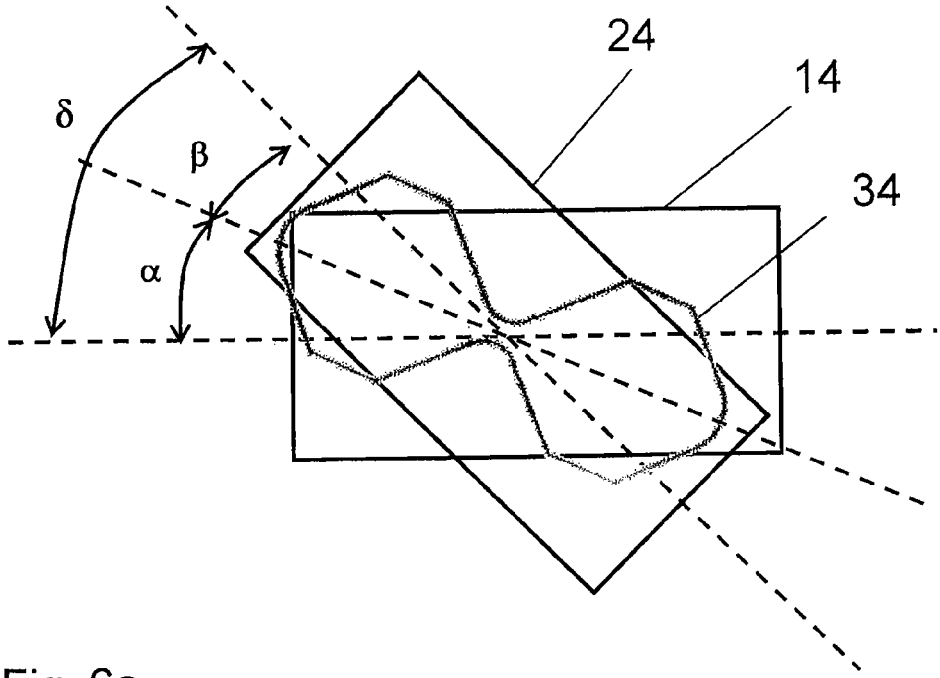
FIGS. 6*a* and 6*b* show a simplified front view of the rotary joint according to the first embodiment, in two different angular positions.
Figure 6B:
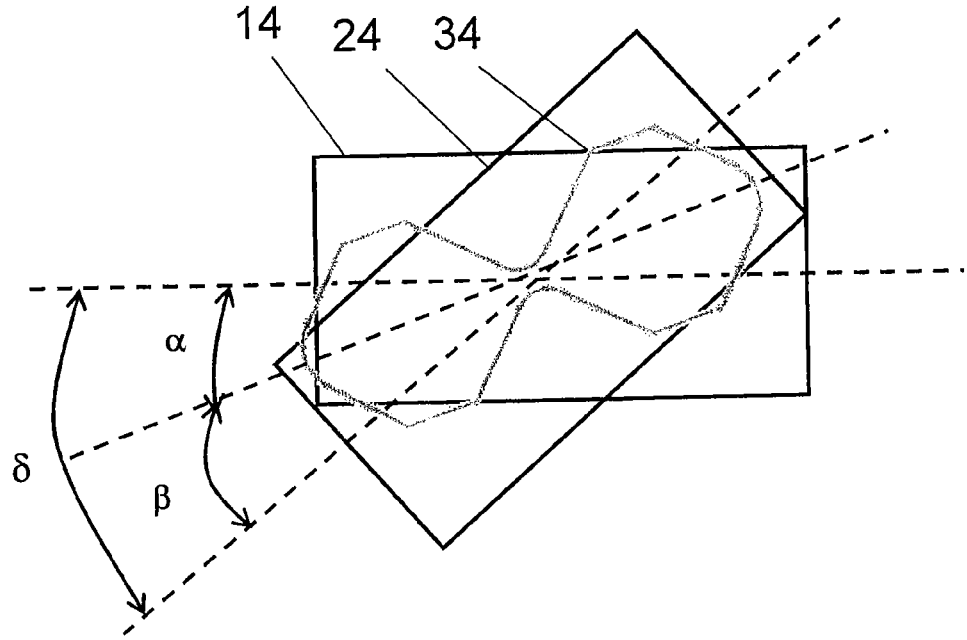

FIG. 6*a* and FIG. 6*b* show a simplified front view of the rotary joint according to the first embodiment, in two different angular positions. For simplification purposes, only the first opening 14 of the first portion 10, the second opening 24 of the second portion 20 and the third opening 34 of the third portion 30 are illustrated in FIG. 6*a* and FIG. 6*b*. The second portion 20 having the second opening 24 receiving the second waveguide 2 is rotatable between a first angular position shown in FIG. 6*a* and a second angular position shown in FIG. 6*b*. Also the third portion 30 adapted for polarization rotation having the third opening 34 in the bow tie shape is rotatable between a first angular position as shown in FIG. 6*a* and a second angular position shown in FIG. 6*b*. In the first setting of FIG. 6*a*, the angular position of the second waveguide 2 with respect to the first waveguide 1 or the first portion 10 is an angle $\delta$ of 45°. In the second setting of FIG. 6*b*, the angular position of the second waveguide 2 with respect to the first waveguide 1 or the first portion 10 is an angle $\delta$ of −45°.

Thus, the waveguide 2 as the antenna under test is rotated by +45° and −45°, in total 90°, in order to acquire two orthogonal field components for the antenna measurement. Hence, the rotary joint is adapted to rotate between a first linear polarization, according to FIG. 6*a*, and a second linear polarization, according to FIG. 6*b*. The first and the second linear polarizations have different directions. They are orthogonal to each other in FIG. 6*a* and FIG. 6*b*, thus the angle between the two polarization directions is 90°.

In a neutral position, the shapes of the first opening 14, the second opening 24 and the third opening 34 would be aligned with each other. The first setting shown in FIG. 6*a* is achieved, in that the third portion 30 having the third opening 34 is rotated by +22.5° and the second portion is rotated by +45°, as can be seen in table 1. The ratio of the angle between the two angular positions of the third portion 30 and the angle between the two angular positions of the second portion equals 0.5 (see table 1). The third portion 30 is rotated by an angle α of +22.5° with respect to the first portion 10 or the first opening 14, and the second portion 20 is rotated by an angle β of +22.5° with respect to the third portion 30 or third opening 34, as can be seen in table 2. This yields a total angle δ of +45°. The angular steps of the two rotatable portions 20, 30 are thus equidistantly, which means that the angular steps of a portion, here second portion 20, with respect to the subsequent portion 30, are the same as the angular steps of that subsequent portion 30 (see table 2).

TABLE 1

| Setting | Position of third portion 30 | Position of second portion 20 |
|---|---|---|
| 1 | +22.5° | +45° |
| 2 | −22.5° | −45° |

TABLE 2

| Setting | α | β | δ |
|---|---|---|---|
| 1 | +22.5° | +22.5° | +45° |
| 2 | −22.5° | −22.5° | −45° |

In the second setting shown in FIG. 6*b*, the third portion 30 is rotated by −22.5° with respect to the first portion 10 or first opening 14, and the second portion 20 is rotated by −45° with respect to the first portion 10 or first opening 14. This yields a total angle δ of −45°. Thus, there is geometrical symmetry with respect to the neutral position. The angle between the first and second position of the second portion 20 is a number that equals 360° divided by an integer number. As can be seen in table 1 and table 2, the angle between the first and the second angular position or setting of the second portion 20 is 90°, thus the integer number is 4. In general, the integer number can be an even or an odd number. In principle, any fractional number is possible. However, for practical applications integer numbers should be used in order to cover a rotational range of 360° in equidistant steps.

In general, since each of the second portion 20 and the third portion 30 is rotatable between exactly two angular positions, there are in total four possible settings, as shown in table 3.

TABLE 3

| Setting | α | β | δ |
|---|---|---|---|
| 1 | +22.5° | +22.5° | +45° |
| 2 | +22.5° | −22.5° | 0 |
| 3 | −22.5° | +22.5° | 0 |
| 4 | −22.5° | −22.5° | −45° |

Figure 7A:
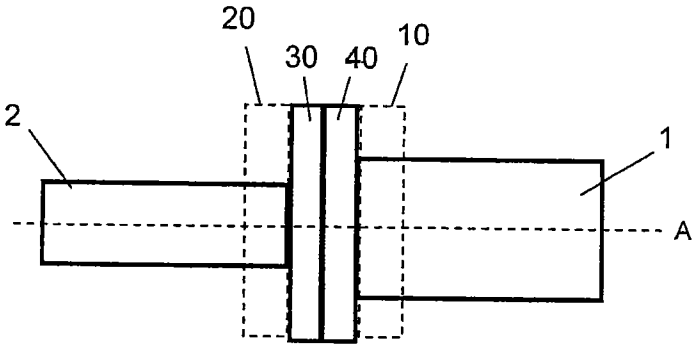
FIG. 7*a* shows a simplified side view of a rotary joint according to a second embodiment.
Figure 7B:
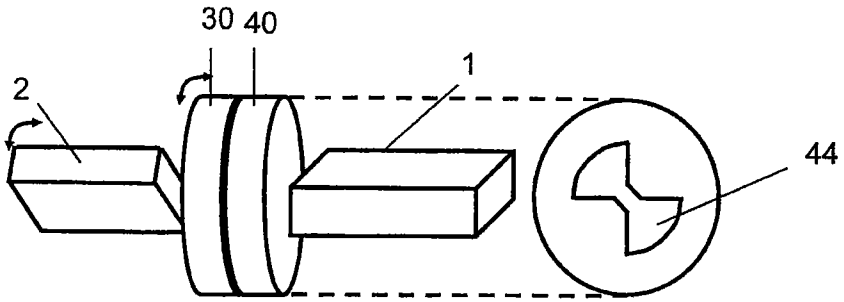
FIG. 7*b* shows a simplified perspective view of the rotary joint according to the second embodiment.

FIG. 7*a* shows a simplified side view of a rotary joint according to a second embodiment and FIG. 7*b* shows a respective simplified perspective view. The rotary joint further comprises a fourth portion 40 arranged between the first portion 10 and the second portion 20 as shown in FIG. 7*a*. The fourth portion 40 is coaxially aligned along the central axis A. The fourth portion 40 is also adapted for polarization rotation. The fourth portion 40 is arranged between the first portion 10 and the third portion 30. The rotary joint is configured such that also the fourth portion 40 is rotatable between at least two angular positions about the central axis A. In particular, the fourth portion 40 has the same form as the third portion 30. As shown in FIG.7*a* and FIG. 7*b*, the fourth portion 40 is also a round slab and has a fourth opening 44 in the slab which has a bow tie shape as shown in FIG. 7*b*.

Figure 8:
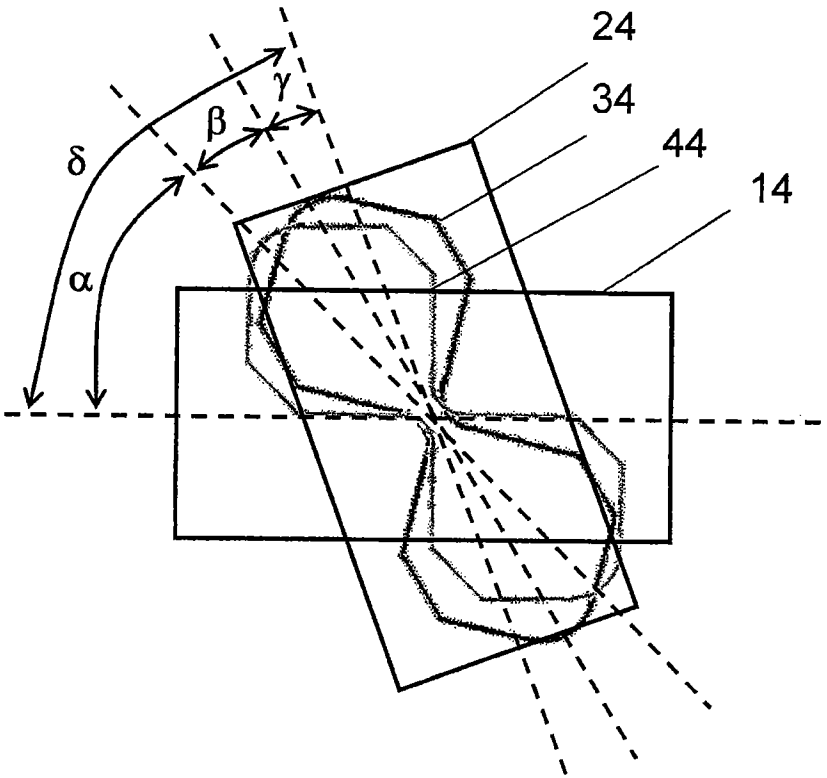
FIG. 8 shows a simplified front view of the rotary joint according to the second embodiment.

FIG. 8 shows a simplified front view of the rotary joint according to the second embodiment. For simplification purposes, only the first opening 14 of the first portion 10, the second opening 24 of the second portion 20, the third opening 34 of the third portion 30, and the fourth opening 44 of the fourth portion 40 are illustrated in FIG. 8. Table 4 shows 8 possible settings of a rotary joint according to the second embodiment. The fourth portion 40 is rotatable by an angle α with respect to the first portion 10 or first opening 14. The third portion 30 is rotatable by an angle β with respect to the fourth portion 40 or fourth opening 44. The second portion 20 is rotatable by an angle γ with respect to the third portion 30 or third opening 34. The angle δ indicates the total rotation angle of the second portion 20 with respect to the first portion 10 or first opening 14. As can be seen in the last column of table 4, the angle between two different settings of the second portion 20 is always 22.5°. As can be seen in table 4, the ratio of the angle α of the fourth portion 40 and the angle β of the third portion 30 equals 2. Similarly, the ratio of the angle β of the third portion 30 and the angle γ of the second portion 20 equals 2. The angular steps of the rotatable portions 20, 30, 40 are thus binary, which means that the angular steps of a portion, with respect to the subsequent portion, are 0.5 times the angular steps of that subsequent portion (see for example table 4). In general, there can be additional rotatable portions, thus more than three rotatable portions. Each rotatable portion can be spaced by half of the rotational angle of the rotatable portion before with respect to that portion.

TABLE 4

| Setting | α | β | γ | δ |
|---|---|---|---|---|
| 1 | −45° | −22.5° | −11.25° | −78.75° |
| 2 | −45° | −22.5° | +11.25° | −56.25° |
| 3 | −45° | +22.5° | −11.25° | −33.75° |
| 4 | −45° | +22.5° | +11.25° | −11.25° |
| 5 | +45° | −22.5° | −11.25° | +11.25° |
| 6 | +45° | −22.5° | +11.25° | +33.75° |
| 7 | +45° | +22.5° | −11.25° | +56.25° |
| 8 | +45° | +22.5° | +11.25° | +78.75° |

It will be understood that the rotary joint can comprise additional portions adapted for polarization rotation and which may also be rotatable. Table 5 shows exemplary settings of an even number of equidistantly spaced rotatable portions, namely 4 portions. Table 6 shows exemplary settings of an odd number of equidistantly spaced portions, namely 3 portions, such as for example in the second embodiment shown in FIG. 7*a* and FIG. 7*b*. However, the rotation angles in Table 6 are different from the rotation angles in FIG. 4.

TABLE 5

| Setting | α | β | γ | φ | δ |
|---|---|---|---|---|---|
| 1 | −30° | −30° | −30° | −30° | −120° |
| 2 | −30° | −30° | −30° | 30° | −60° |
| 3 | −30° | −30° | 30° | −30° | −60° |
| 4 | −30° | −30° | 30° | 30° | 0° |

TABLE 5-continued

| Setting | α | β | γ | φ | δ |
|---|---|---|---|---|---|
| 5 | −30° | 30° | −30° | −30° | −60° |
| 6 | −30° | 30° | −30° | 30° | 0° |
| 7 | −30° | 30° | 30° | −30° | 0° |
| 8 | −30° | 30° | 30° | 30° | 60° |
| 9 | 30° | −30° | −30° | −30° | −60° |
| 10 | 30° | −30° | −30° | 30° | 0° |
| 11 | 30° | −30° | 30° | −30° | 0° |
| 12 | 30° | 30° | 30° | 30° | 120° |
| 13 | 30° | 30° | −30° | −30° | 0° |
| 14 | 30° | 30° | −30° | 30° | 60° |
| 15 | 30° | 30° | 30° | −30° | 60° |
| 16 | 30° | 30° | 30° | 30° | 120° |

TABLE 6

| Setting | α | β | γ | δ |
|---|---|---|---|---|
| 1 | −30° | −30° | −30° | −90° |
| 2 | −30° | −30° | 30° | −30° |
| 3 | −30° | 30° | −30° | −30° |
| 4 | −30° | 30° | 30° | 30° |
| 5 | 30° | −30° | −30° | −30° |
| 6 | 30° | −30° | 30° | 30° |
| 7 | 30° | 30° | −30° | 30° |
| 8 | 30° | 30° | 30° | 90° |

The invention has been illustrated and described in detail in the drawings and foregoing description, but such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable non-transitory medium, such as an optical storage medium or a solid-state medium supplied together with or as portion of other hardware, but may also be distributed in other forms, such as via the Internet or other wired or wireless telecommunication systems.

Any reference signs in the claims should not be construed as limiting the scope.

It follows a list of further embodiments:

In embodiment 1, a rotary joint for joining two waveguides for guiding electromagnetic waves, comprising: a first portion adapted to receive a first waveguide; a second portion adapted to receive a second waveguide; and a third portion adapted for polarization rotation and arranged between the first portion and the second portion; the rotary joint being configured such that two portions selected from the group comprising the first portion , the second portion and the third portion are rotatable between at least two different angular positions around a central axis, the rotary joint being configured to switch between a jointed state, in which the portions contact each other for electrical connection, and a non-jointed state.

In embodiment 2, the rotary joint of embodiment 1, wherein, in the jointed state, a first electrical contact surface of the first portion and a third electrical contact surface of the third portion contact each other for electrical connection, and a second electrical contact surface of the second portion and a fourth electrical contact surface of the third portion contact each other for electrical connection.

In embodiment 3, the rotary joint of embodiment 1 or 2, wherein, in the non-jointed state, there is less contact pressure and/or abrasion, compared to the jointed state, between the portions.

In embodiment 4, the rotary joint of embodiment 2 or 3, wherein there is less contact pressure and/or abrasion, compared to the jointed state, between the first electrical contact surface and the third electrical contact surface and between the second electrical contact surface and the fourth electrical contact surface.

In embodiment 5, the rotary joint of one of the preceding embodiments, wherein, in the non-jointed state, there are gaps between the portions.

In embodiment 6, the rotary joint of one of the preceding embodiments, wherein, in the non-jointed state, a first gap is formed between the first electrical contact surface of the first portion (10) and the third electrical contact surface of the third portion, and a second gap is formed between the second electrical contact surface of the second portion and the fourth electrical contact surface of the third portion.

In embodiment 7, the rotary joint of one of the preceding embodiments, the rotary joint being adapted to switch between the jointed state and the non jointed state by rotating the two rotatable portions such that the portions are lifted away from each other in the direction of the central axis.

In embodiment 8, the rotary joint of one of the preceding embodiments, wherein, in the jointed state and in the non-jointed state, a first mechanical contact surface of the first portion and a third mechanical contact surface of the third portion contact each other, and a second mechanical contact surface of the second portion and a fourth mechanical contact surface of the third portion contact each other.

In embodiment 9, the rotary joint of embodiment 8, wherein the mechanical contact surfaces are in the form of a cam or wave having multiple alternating convex and concave partitions.

In embodiment 10, the rotary joint of embodiment 9, wherein the convex and concave partitions are arranged such that an angular spacing between two of the concave partitions or between two of the convex partitions depends on the at least two angular positions.

In embodiment 11, the rotary joint of embodiment 9 or 10, wherein, in the jointed state, the convex partitions of each of the mechanical contact surfaces engage with the concave partitions of its adjacent mechanical contact surface.

In embodiment 12, the rotary joint of one of embodiments 9 to 11, wherein, in the non-jointed state, the convex partitions of each of the mechanical contact surfaces contact the convex partitions of its adjacent mechanical contact surface.

In embodiment 13, the rotary joint of one of the preceding embodiments, wherein the third portion is a slab.

In embodiment 14, the rotary joint of one of the preceding embodiments, wherein the third portion comprises an opening for polarization rotation.

In embodiment 15, the rotary joint of embodiment 14, wherein the opening has a bow tie shape.

In embodiment 16, the rotary joint of one of the preceding embodiments, wherein the two rotatable portions are independently from each other rotatable.

In embodiment 17, the rotary joint of one of the preceding embodiments, further comprising at least one actuator adapted to rotate the two rotatable portions.

In embodiment 18, the rotary joint of embodiment 17, comprising a single actuator, in conjunction with a gearbox, which is used to rotate both the second portion and the third portion.

In embodiment 19, the rotary joint of one of the preceding embodiments, the rotary joint being configured such that the first portion is fixed and such that the second portion and the third portion are each rotatable between the at least two different angular positions around the central axis.

In embodiment 20, the rotary joint of embodiment 19, wherein the angle between the two angular positions of the second portion is a number that equals 360° divided by an integer number.

In embodiment 21, the rotary joint of embodiment 19 or 20, wherein the ratio of the angle between the two angular positions of the third portion and the angle between the two angular positions of the second portion equals 0.5.

In embodiment 22, the rotary joint of one of the preceding embodiments, further comprising at least a fourth portion arranged between the first portion and the second portion and adapted for polarization rotation, the rotary joint being configured such that the fourth portion is rotatable between at least two angular positions around the central axis.

In embodiment 23, the rotary joint of one of the preceding embodiments, wherein the rotary joint is adapted to rotate between a first linear polarization and a second linear polarization, the first and second linear polarizations having different directions.

In embodiment 24, the rotary joint of one of the preceding embodiments, wherein the portions, are coaxially aligned along the central axis.

In embodiment 25, the rotary joint of one of the preceding embodiments, wherein the first waveguide is connected to a signal generator, and wherein the second waveguide is a probe.

In embodiment 26, the rotary joint of one of the preceding embodiments, wherein the first waveguide and the second waveguide are each a hollow waveguide.

In embodiment 27, the rotary joint of one of the preceding embodiments, wherein the first waveguide and the second waveguide are each a rectangular waveguide.

The invention claimed is:

1. A rotary joint for joining two waveguides for guiding electromagnetic waves, comprising:

a first portion adapted to receive a first waveguide;

a second portion adapted to receive a second waveguide; and a third portion adapted for polarization rotation and arranged between the first portion and the second portion, the rotary joint being configured such that two portions selected from the group comprising the first portion, the second portion and the third portion are rotatable between at least two different angular positions around a central axis, the rotary joint being configured to switch between a jointed state, in which the first portion, the second portion, and the third portion contact each other for electrical connection, and a non-jointed state, in which the first portion, the second portion, and the third portion have no contact or less contact with each other as compared to the jointed state, and the rotary joint being adapted to switch between the jointed state and the non-jointed state by rotating the two rotatable portions such that the two rotatable portions are lifted away from each other in a direction of the central axis.

2. The rotary joint of claim 1, wherein, in the jointed state, a first electrical contact surface of the first portion and a third electrical contact surface of the third portion contact each other for electrical connection, and a second electrical contact surface of the second portion and a fourth electrical contact surface of the third portion contact each other for electrical connection.

3. The rotary joint of claim 1, wherein, in the non-jointed state, there is less contact pressure and/or abrasion between the first portion, the second portion, and the third portion, as compared to in the jointed state.

4. The rotary joint of one of the preceding claims, wherein, in the non-jointed state, there are gaps between the first portion, the second portion, and the third portion.

5. The rotary joint of claim 1, wherein each of the first waveguide and the second waveguide is a rectangular waveguide.

6. The rotary joint of claim 1, wherein, in the jointed state and in the non-jointed state, a first mechanical contact surface of the first portion and a third mechanical contact surface of the third portion contact each other, and a second mechanical contact surface of the second portion and a fourth mechanical contact surface of the third portion contact each other.

7. The rotary joint of claim 6, wherein the first mechanical contact surface, the second mechanical contact surface, the third mechanical contact surface and the fourth mechanical contact surface have multiple alternating convex and concave partitions.

8. The rotary joint of claim 7, wherein the convex and concave partitions are arranged such that an angular spacing between two of the concave partitions or between two of the convex partitions depends on the at least two different angular positions.

9. The rotary joint of claim 7, wherein, in the jointed state, the convex partitions of each of the first mechanical contact surface, the second mechanical contact surface, the third mechanical contact surface and the fourth mechanical contact surface engage with the concave partitions of an adjacent mechanical contact surface thereof.

10. The rotary joint of claim 7, wherein, in the non-jointed state, the convex partitions of each of the first mechanical contact surface, the second mechanical contact surface, the third mechanical contact surface and the fourth mechanical contact surface contacts the convex partitions of an adjacent mechanical contact surface thereof.

11. The rotary joint of claim 1, wherein the third portion comprises an opening for polarization rotation.

12. The rotary joint of claim 11, wherein the opening has a bow tie shape.

13. The rotary joint of claim 1, wherein the two rotatable portions are rotatable independently from each other.

14. The rotary joint of claim 1, wherein the rotary joint is configured such that the first portion is fixed and such that the second portion and the third portion are each rotatable between the at least two different angular positions around the central axis.

15. The rotary joint of claim 14, wherein a first angle between the at least two different angular positions of the second portion is a number that equals 360° divided by an integer number.

16. The rotary joint of claim 14, wherein a ratio of a second angle between the at least two different angular positions of the third portion and a first angle between the at least two different angular positions of the second portion equals 0.5.

17. The rotary joint of one claim 1, further comprising at least a fourth portion arranged between the first portion and the second portion and adapted for polarization rotation, the rotary joint being configured such that the fourth portion is rotatable between the at least two different angular positions around the central axis.

18. The rotary joint of claim 1, wherein the rotary joint is adapted to rotate between a first linear polarization and a second linear polarization, the first linear polarization and the second linear polarization having different directions.

19. The rotary joint of claim 1, wherein each of the first waveguide and the second waveguide is a hollow waveguide.

20. A method of operating a rotary joint for joining two waveguides for guiding electromagnetic waves, the rotary joint comprising a first portion adapted to receive a first waveguide, a second portion adapted to receive a second waveguide, and a third portion adapted for polarization rotation and arranged between the first portion and the second portion, the rotary joint being configured such that two portions selected from the group comprising the first portion, the second portion and the third portion are rotatable between at least two different angular positions around a central axis, the method comprising:

switching between a jointed state, in which the first portion, the second portion, and the third portion contact each other for electrical connection, and a non-jointed state, in which the first portion, the second portion, and the third portion have no contact or less contact with each other as compared to the jointed state; and rotating each of the two rotatable portions between the at least two different angular positions, wherein the rotary joint is adapted to switch between the jointed state and the non-jointed state by rotating the two rotatable portions such that the two rotatable portions are lifted away from each other in a direction of the central axis.

21. A computer readable non-transitory medium having instructions stored thereon which, when carried out on a computer, cause the computer to perform the method as claimed in claim 20.

* * * * *